United States Patent [19]

Stokley et al.

[11] Patent Number: 4,823,882

[45] Date of Patent: Apr. 25, 1989

[54] MULTIPLE-SET PACKER AND METHOD

[75] Inventors: Charles O. Stokley; Lawrence Sanford, both of Houston, Tex.

[73] Assignee: TAM International, Inc., Houston, Tex.

[21] Appl. No.: 204,087

[22] Filed: Jun. 8, 1988

[51] Int. Cl.[4] ..... E21B 23/06; E21B 33/127

[52] U.S. Cl. ..... 166/387; 166/120; 166/187; 166/188; 166/194; 166/195; 166/238; 166/239; 166/318; 166/334

[58] Field of Search ..... 166/387, 187, 120, 122, 166/188, 192, 193, 194, 195, 203, 318, 238, 239, 237, 332, 334

[56] References Cited

U.S. PATENT DOCUMENTS

| | | | |
|---|---|---|---|
| 3,053,322 | 9/1962 | Kline | 166/318 X |
| 3,112,796 | 12/1963 | Myers | 166/120 |
| 3,189,095 | 6/1965 | De Rochemont | 166/120 |
| 3,211,226 | 10/1965 | Myers et al. | 166/120 |
| 3,524,503 | 8/1970 | Baker | 166/188 X |
| 3,606,924 | 9/1971 | Malone | 166/187 |
| 3,941,190 | 3/1976 | Conover | 166/187 |
| 3,948,322 | 4/1976 | Baker | 166/187 X |
| 4,520,870 | 6/1985 | Pringle | 166/239 X |
| 4,648,448 | 3/1987 | Sanford et al. | 166/191 |

FOREIGN PATENT DOCUMENTS

| | | | |
|---|---|---|---|
| 800339 | 1/1981 | U.S.S.R. | 166/120 |
| 926238 | 5/1982 | U.S.S.R. | 166/120 |
| 950899 | 8/1982 | U.S.S.R. | 166/120 |
| 1067199 | 1/1984 | U.S.S.R. | 166/187 |
| 1213175 | 2/1986 | U.S.S.R. | 166/120 |

*Primary Examiner*—Hoang C. Dang

*Attorney, Agent, or Firm*—Browning, Bushman, Zamecki & Anderson

[57] ABSTRACT

A packer assembly is provided suitable for multiple setting and unsetting operations in a well bore during a single trip to seal the annulus between the interior walls of the well bore and a tubing string. Thge packer is set by dropping a metal ball which plugs the passageway through the tubing string, such that tubing pressure may thereafter be increased to inflate the packer. A sleeve is axially movable within a control sub from a ball stop position to a ball release position, and has a cylindrical-shaped interior surface with a diameter only slightly greater than the ball. Collet fingers carried on the sleeve are radially movable from an inward position to an outward position to stop or release the ball as a function of the axial position of the sleeve. Fluid flow through the tubing string is thus effectively blocked when the sleeve is in the ball stop position because of the close tolerance between the sleeve and the ball, while the ball is freely released from the sleeve and through the packer assembly when the sleeve is moved to the ball release position.

20 Claims, 3 Drawing Sheets

MULTIPLE-SET PACKER AND METHOD

BACKGROUND OF THE INVENTION

1. Field of the Invention

The present invention relates to downhole tools which can be repeatedly activated and deactivated within the well bore and, more particularly, relates to improved techniques for repeatedly setting an inflatable packer suspended in a well bore from a tubular string by creating an obstruction to fluid flow through the tubular conduit to increase fluid pressure in the conduit, and for thereafter removing the obstruction to permit flow through the conduit while the packer remains set.

2. Description of the Background

Downhole tools of various types may be activated or deactivated by increasing fluid pressure in a tubular conduit in the well bore, thereby transmitting increased fluid pressure to the tool sufficient to move a piston, inflate an elastomeric member, or otherwise activate the tool. A ball or other closure member is conventionally lowered (dropped) through the conduit to cooperate with a seat and substantially restrict or terminate fluid flow through the conduit, thereby allowing for the subsequent increase in fluid pressure. This increased pressure is typically supplied by mud pumps at the surface of the well bore, such that the necessary downhole pressure required to activate the tool may be easily controlled at the surface. In most cases, the obstruction created by the ball or other closure member must be removed once the tool is activated, since other downhole equipment must frequently be passed through the conduit by a wireline or smaller diameter tubing, and/or fluid must be passed downward or upward through the tubing string.

Downhole equipment may be generally characterized as either "single-set" or "multiple-set" equipment. Single-set equipment can be activated or set in the well bore, and then be deactivated and retrieved to the surface. As the name suggests, however, single-set downhole equipment must be repaired or reworked prior to being reactivated or reset in the well bore. Multiple-set downhole equipment, on the other hand, has a capability of being repeatedly activated and deactivated in the well bore without being retrieved to the surface for repair or replacement of components. Since the expense associated with the "trip time" required to retrieve and replace a downhole tool is considerable, multiple-set downhole equipment has significant advantages over single-set tools.

One downhole tool which can be activated by increasing tubing pressure is an inflatable or hydraulically set packer. A single-set hydraulic packer assembly may typically be provided with an annular seat ring which is shear pinned to a sub which serves as a portion of the conduit which defines the tubing string. The packer may thus be set by dropping a ball to seal with this seat ring, and fluid pressure then increased in the tubing string, which is then passed to the elastomeric packer body through a flow path in the sub to inflate or set the packer in the well bore. Pressure in the tubing string may thereafter be increased beyond the packer setting pressure to shear a pin which interconnects the seat ring and the sub, thereby "blowing out" the ball. A check valve within the flow path of the sub may close off fluid flow from the packer body back to the interior of the tubing string, so that the ball removal operation does not unset the packer. Accordingly, tools and fluid may thereafter be passed through the tubing string by the location which was previously restricted by the seat and ball.

Since the ball and seat are "blown out" in a typical single-set hydraulic packer, this procedure cannot be effectively used for a multiple-set packer. While it might be theoretically possible to provide various diameter seats in a packer assembly, with each seat adapted to receive an increasingly larger diameter ball, this technique is impractical due to cost considerations and the preference for "full bore" downhole equipment. In other words, with the obstruction (ball) removed, the packer assembly preferably has a passageway substantially close to the interior diameter or bore of the tubing string, so that equipment can pass through the packer body without getting "hung up" or damaged, and so that fluid flow through the packer and thus the tubing string is not substantially restricted.

Accordingly, prior art multiple-set packer assemblies typically use a plastic material (PVC) ball to block flow through the tubing string and thereby allow for the increase in fluid pressure to set the packer. An increase in tubing pressure beyond the packer setting pressure ideally causes the ball to deform (its edges sheared), so that the ball passes through a seat greater in diameter than the normal diameter of the ball. Accordingly, a ball can be dropped for engagement with the seat, tubing pressure increased and the packer set, pressure further increased in the tubing string to deform the ball past the seat, the packer subsequently unset, and a new plastic ball dropped for repeating the operation.

A packer assembly adapted to receive a plastic ball as described above has, however, significant disadvantages. Downhole temperature is often high and variable, and temperature drastically affects the force and thus the tubing pressure required to extrude the ball past the metal seat. Since the amount of pressure required to blow the ball past the seat is highly variable, the reliability of the equipment is in question. Secondly, the outer surface of a plastic ball is frequently damaged as the ball is transported down through the conduit (dropped) to the seat. This damage to the surface of the ball thus alters the pressure required to extrude the ball through the seat and adversely affects sealing reliability with the seat. Thirdly, plastic balls generally have a density substantially close to the density of fluids which are in the conduit or tubing string. Thus, a plastic ball falls slowly through this fluid, requiring a great deal of time. Although techniques have been utilized to increase the velocity of the ball being transported through the conduit to the seat, such as providing a ball with a plastic exterior and an inner high density core, the increased velocity of the ball increases the likelihood of damage to the surface of the ball as the ball travels to the seat.

The above-described disadvantages of packer assemblies adapted to receive plastic balls have long been recognized in the art, and it is thus conventional for a multiple-set packer assembly to have one seat adapted to receive a metal ball, which seat and ball are typically "blown out" in the manner similar to that described for a single-set packer. Thereafter, plastic balls are used to repeatedly engage another "permanent" seat in the packer. The use of the metal ball thus results in high reliability for the first packer setting operation, while subsequent packer setting operations are not as reliable due to the use of plastic balls for obstructing the fluid flow through the tubing.

The disadvantages of the prior art overcome by the present invention, and improved methods and apparatus are hereinafter disclosed for repeatedly creating an obstruction in a downhole tool so that tubing pressure can be increased to activate the tool, and the obstruction thereafter easily and reliably removed to permit equipment and fluid to pass through the tubing string.

SUMMARY OF THE INVENTION

The present invention allows for the repeated activation or setting of a packer assembly or other downhole tool in a well bore by increasing fluid pressure in the tubing string. The passageway through the tubing string is temporarily blocked by a metallic closure member, such as a ball, which results in high reliability for the successive setting operations.

The passageway through the tubing string may be provided with a sleeve having a cylindrical-shaped interior surface of a diameter only slightly larger than the diameter of the ball. One or more collet fingers carried by the sleeve are provided at a lower end of the sleeve, and are each held in its radially inward position by a control sub affixed to the packer, thereby ensuring that the collet fingers will engage the ball and retain the ball within the similarly sized flow path through the sleeve. Fluid pressure may then be increased in the tubing string in a conventional manner, with the increased tubing pressure being passed to the elastomeric packer body to set the packer. Once the packer is set, the sleeve may be moved axially to its ball release position, at which time the collet fingers may move radially outwardly into a recess provided in the control sub. As the sleeve moves downward, a seal automatically blocks off communication between the interior of the tubing string and the packer body, thereby maintaining the packer body in its set position. With the sleeve moved to its ball release position, the ball can thus pass by the collet fingers and proceed downward through the tubing string to a location which does not obstruct the subsequent flow of equipment or fluid through the tubing string. The sleeve may be subsequently returned to its initial ball stop position, such that the packer may be subsequently unset and reset in the well bore without being returned to the surface.

According to one technique of the present invention, the axial movement of the sleeve is accomplished by manipulating the tubing string at the surface. "Set down" and "pick up" action on the tubing string thus determines whether the sleeve is in its ball stop or ball release position. In another embodiment, the sleeve may be shear pinned in its ball stop position, so that an increase in fluid pressure beyond the packer setting pressure will shear the pin, thereby allowing the tubing pressure to move the sleeve to the ball release position, thus discharging the ball. The sleeve may then be returned to the ball stop position and thereafter moved to the ball release position by manually manipulating the tubing string at the surface.

It is an object of the present invention to provide an improved downhole tool which may be reliably activated more than one time within a well bore without returning the tool to the surface of the well bore.

It is another object of the present invention to provide a technique for repeatedly blocking off fluid flow through a tubing string with a closure member having a relatively hard exterior surface, such that the surface of the closure member is not easily damaged.

It is another object of the present invention to provide an improved downhole tool adapted to be activated by lowering a closure member through a tubing string to plug the tubing flow passageway and thereafter increase fluid pressure in the tubing string to activate the tool, with the tool including a control sub having a recessed cavity, a sleeve axially movable within the control sub from a stop position to a release position, the sleeve having an interior surface with a selectively sized diameter only slightly larger than the diameter of the closure member, and a stop member carried by the sleeve and radially movable from an inward position such that the closure member is axially stopped by the stop member, to an outward position such that the closure member may be passed axially by the stop member.

It is a feature of the present invention to provide a downhole tool with a mechanism for repeatedly blocking fluid flow through a tubing string to increase fluid pressure in the tubing string for activating the tool, wherein the reliability of the blocking mechanism is not significantly influenced by the temperature or fluid in the well bore.

The techniques of the present invention are well adapted to reliably setting a packer assembly in a well bore more than one time without returning the packer assembly to the surface. The packer setting apparatus of the present invention is adapted for receiving a metallic ball to temporarily block off the flow of fluid through the tubing string, with the metallic ball being highly resistant to damage along its outer surface as it is passed through the tubing string to the packer setting apparatus, and with the metallic ball having a desired density so that it may be quickly passed through fluid within the tubing string.

These and further objects, features and advantages of the present invention will become apparent from the following detailed description, when reference is made to the figures in the accompanying drawings.

DETAILED DESCRIPTION OF PREFERRED EMBODIMENTS

A multi-set packer assembly is herein disclosed which has a capability of being reliably set numerous times in a well bore without retrieving the packer assembly to the surface. The packer assembly includes a conventional elastomeric packer body which may be hydraulically set by increasing fluid pressure in the tubular string above the packer, i.e., increased pressure causes the elastomeric packer body to expand radially (inflate) into sealing engagement with the walls of the borehole. Inflatable packer assemblies of this type are well known in the petroleum recovery industry, and their advantages compared to other packers have long been recognized. Inflatable packers are typically intended to seal against the interior surface of a larger tubular member (cased hole) as described below, but may also be used to seal against the side walls of the formation (open hole).

Figure 1:
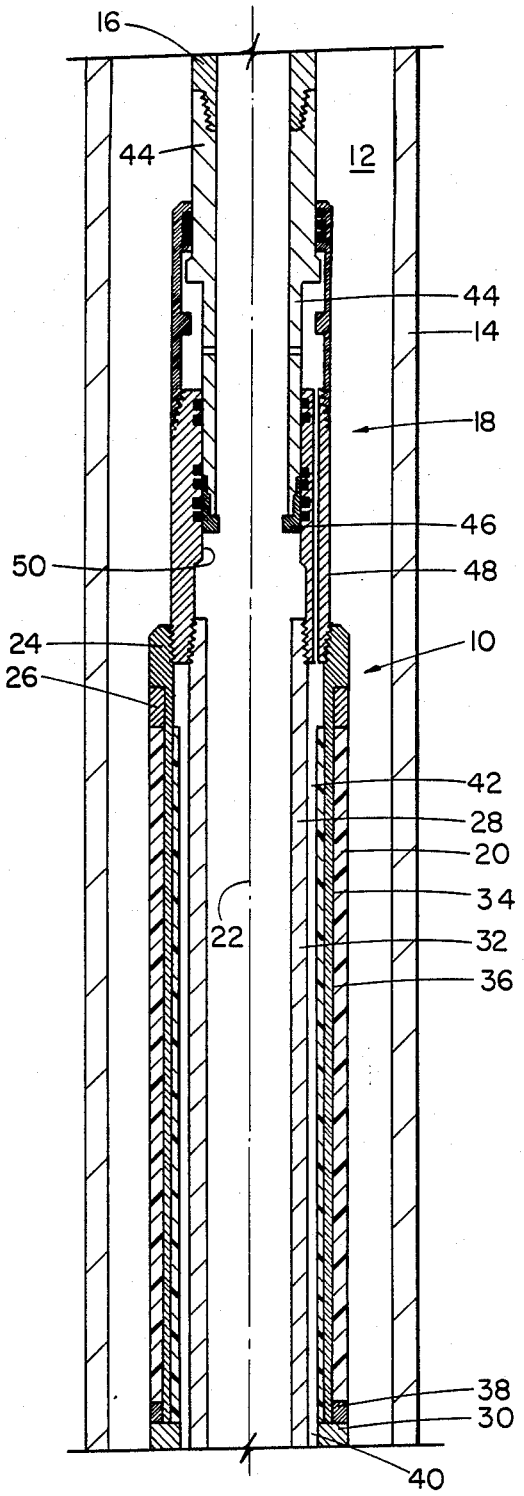
FIG. 1 is a cross-sectional view of a suitable packer according to the present invention in set position within a downhole casing.

Referring now to FIG. 1, the packer assembly 10 of the present invention is shown positioned in a well bore 12 defined by a downhole casing 14. The packer assembly 10 is conventionally suspended from a tubular string, tubing conduit, or work string 16 (hereafter tubing string) which extends to the surface of the borehole. The lower end of the packer assembly 10 may be connected by a suitable sub to various other downhole tools including, for example, another packer assembly (not shown). As those skilled in the art recognize, the basic purpose of the packer assembly is to seal the annulus between the tubing string 16 and the casing 14 either above or below the packer assembly, and the packer or packer assembly is shown in its run-in or unset condition in FIG. 1. According to the present invention, the packer assembly may be deflated by reducing pressure in the tubing string 16, and may be subsequently reinflated at the same or a different depth in the borehole.

A suitable packer assembly includes a control subassembly 18 and a packer body 20 generally provided below 18, with both subassembly 18 and packer body 20 each centrally positioned about axis 22. An upper ring 24 is threadedly connected to the control subassembly 18, and a support ring 26 fixes the upper end of the packer body 20 to ring 24. Tubular mandrel 28 is also threadedly connected to 18, and extends downward past the packer body to provide the effective extension of the tubular string 16, i.e., a sealed interior flow path for transmission of wireline equipment and/or fluids. Each of the threaded connections shown in FIG. 1 may be provided with an elastomeric seal (not shown) to ensure sealing engagement of the components. A lower ring 30 is slidably provided on mandrel 28 and moves in a conventional manner axially toward ring 24 during the packer setting operation, and axially away from ring 24 during the packer unsetting or release operation. The packer body, which typically includes an inner elastomeric tube member 32, an outer elastomeric cover member 34, and intermediate metal reinforcing members 36, is connected at its lower end to the slidable ring 30 by lower support ring 38. In the event that a lower packer assembly or other tubing pressure responsive tool is provided in the well bore below assembly 10, a flow path 40 between the ring 30 and the mandrel 28 provides pressure communication from the cavity 42 between the inner elastomeric member 32 and the mandrel 28 to a conduit (not shown) connected to the lower packer assembly or lower tool. Accordingly, the same control subassembly 18 may be used to simultaneously inflate one or more packer assemblies.

The control subassembly 18 comprises a control tube or sleeve 44 threadedly connected to tubing string 16, and collet fingers 46 carried at the lower end of tube 44 to move radially inward or outward to stop or release the axial position of the ball or other closure member. A control sub 48 has an interior surface 50 which restricts radial outward movement of the collet fingers 46 when the control tube 44 is in the position shown in FIG. 1. As explained subsequently, the control tube 44 moves axially from a ball stop position to a ball release position to effectively control radial movement of collet fingers 46. Although the packer body 20 shown in FIG. 1 in its inflated position, the control subassembly 18 is depicted in its "run in" position, which may be maintained by the weight of the packer body 20 and equipment below the packer assembly which is interconnected to mandrel 28. Alternatively, a spring (not shown) may be provided above the control sub and in engagement with a collar on the tubing string for biasing the control sub in its downward position relative to the control sleeve.

Figure 2:
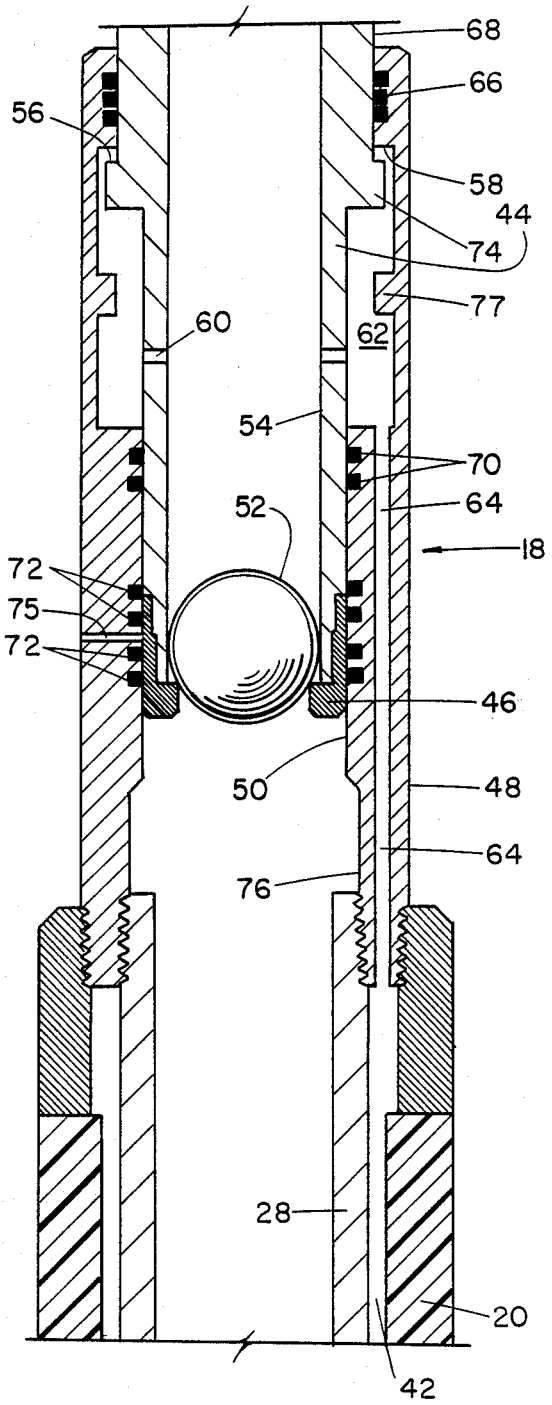
FIG. 2 is a cross-sectional view with the upper portion of the apparatus shown in FIG. 1, with the axially-movable sleeve of the apparatus in its ball stop position and a ball prevented from further downward movement by the stop members.

FIG. 2 depicts in greater detail the components of subassembly 18, and shows a metal spherical closure member (steel ball) 52 in engagement with fingers 46. To hydraulically set the packer assembly 10, the ball 52 may be dropped in a conventional manner from the surface through the tubing string 16. Since the ball is preferably fabricated from hardened steel, its surface will not become easily damaged as it is passed through the tubing string. Also, since the ball has a density substantially greater than that of the fluid in the tubing string, the ball 50 will drop relatively quickly through the tubing string and, once it engages collet fingers 46, will not inadvertently "float" or rise out of the control subassembly 18.

The control tube 44 has a cylindrical inner surface 54 of a diameter only slightly greater than the diameter of the ball 52. Once the ball 52 is in the position as shown in FIG. 2 and pressure in the tubing string 16 is increased, the close tolerance between the cylindrical surface 54 of the control tube 44 and the ball 52 effectively blocks off fluid flow past the ball to allow pressure in the tubing string to increase. Although some leakage past the ball 52 is permissible during inflation of the packer body 20 (which is shown generally as an elastomeric member in FIGS. 2–5), this close tolerance thus effectively shuts off fluid flow to allow the packer assembly to be set in the well bore. The increased tubing pressure will, of course, act on the ball 52 and try to force the multiple collet fingers 46 radially outward. As long as the control tube 44 is in the ball stop position, however, the interior surface 50 of control sub 48 prevents this radial outward movement.

Ball 52 is easily sized so that it cannot pass by the collet fingers 46 as long as the control tube 44 is in its ball stop position. The diameter of cylindrical surface 54 will be known before dropping the ball and, if desired, the diameter of ball 52 may be selected to effectively control the permissible amount of leakage past the ball. Typically, the packer assembly 10 adapted to seal with a $7\frac{5}{8}$ inches diameter casing would have an interior surface 54 of approximately 2.501 inches, and a ball diameter of from 2.500 to 2.499 would be used to block off flow of fluid through the tubing string.

In this run in position, stop shoulder 56 on control tube 44 would typically be in engagement with surface 58 on control sub 48. With the ball 52 positioned as shown in FIG. 2, surface mud pumps may be used to increase the pressure in the tubing string 16 above the ball. This increased tubing pressure passes through ports 60 in the control tube 44 and into cavity 62 provided for the J-action (described subsequently) which allows for axial movement of the control tube 44. Fluid passage 64 through the control sub 48 establishes pressure communication between cavity 62 and cavity 42 between the mandrel 28 and the packer body 20. Conventional seals 66 seal between the upper portion of the control sub 48 and the outer cylindrical surface 68 of the control tube 44, while seals 70 similarly seal between the inner cylindrical surface 50 of the control sub 48 and control tube 44.

Tubing pressure at the surface can be monitored in a conventional manner to obtain the desired setting pressure of the packer assembly. Once this pressure has been obtained, the tubing string at the surface may be "picked up" and rotated (typically a quarter turn to the right) to move the latching mechanism 74 out of locking engagement with the J-shaped slot, which is defined by inner portion 77 on the control sub 48. The tubing string may then be "slacked off" or lowered, allowing the control tube 44, collet fingers 46, and mandrel 28 to move axially downward with respect to the control sub 48, which is fixed to the set packer body 20. Accordingly, control tube 44 will move axially from the ball stop position shown in FIG. 2 to the ball release position shown in FIG. 3, which will automatically move ports 60 below seals 70, so that seals 66, seals 70 and seals 72 isolate the sealed packer body 20 from pressure inside the tubing string 16.

Figure 3:
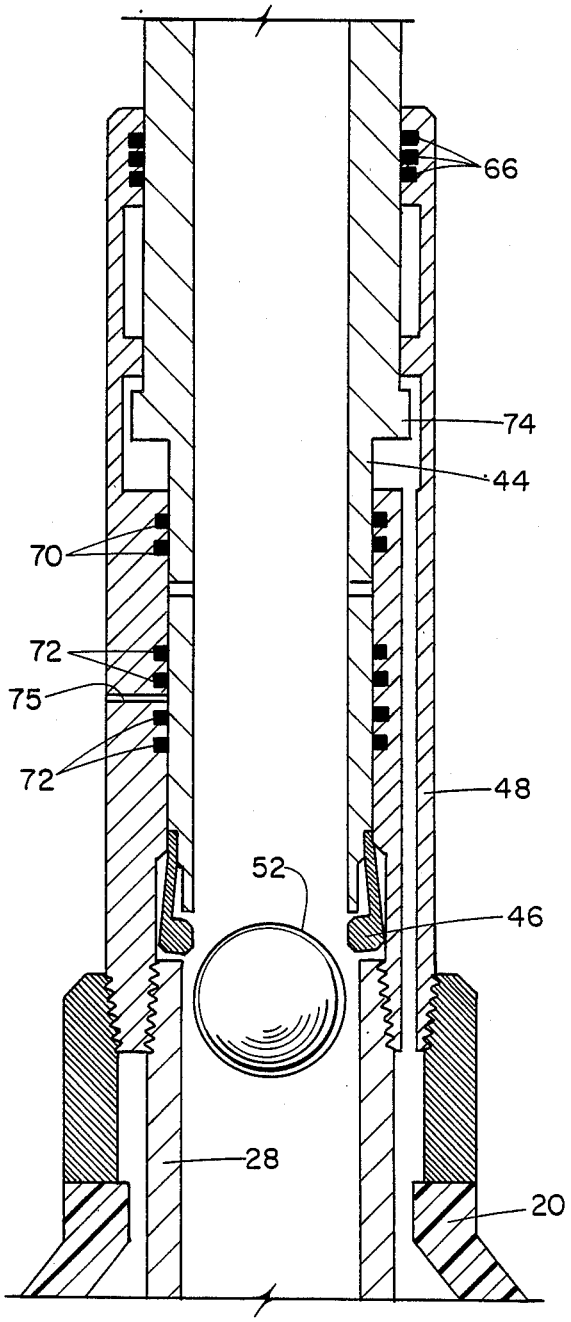
FIG. 3 is a cross-sectional view of the apparatus shown in FIG. 2 with the sleeve moved to its ball release position, and illustrating the ball passing by the stop members.

The lower end of the control sub 48 is provided with an annular recess having an inner diameter 76 greater than the diameter of the cylindrical surface 50. When the control tube 44 moves to the ball release position is shown in FIG. 3, the plurality of collet fingers 46 are free to move radially into this recess, as shown in FIG. 3, thereby releasing the ball from the packer assembly 10. During this operation, the packer will, of course, remain in sealed engagement with the casing 14. Further details regarding the mechanism and operation of the J-action to move the control tube 44 from the ball stop to the ball release position are described in U.S. Pat. No. 4,648,448, which is hereby incorporated by reference.

Once the ball has been released from the packer assembly, the tubing string is reopened to "full bore" capability, so that equipment or tools suspended from a wireline or coiled tubing can be passed through the mandrel 28 of the set packer. Also, the interior of the tubing string is not substantially restricted to fluid flow, so that injection fluids can be passed through the tubing string past the packer into the formation, and formation fluids can be recovered through the interior of the packer and the tubing string to the surface.

In order to unset the packer, the operator at the surface may "set down" with a preselected force, e.g., 2000 pounds, and rotate the tubing string one quarter turn to the right. The operator may then pick up on the tubing string, thereby raising the ports 60 above seals 70 and releasing the inflation fluid back to the interior of the tubing string, thereby deflating the packer and returning the control tube to the ball stop position as shown in FIG. 2. Port 75 in the control sub 48 allows for equalization of pressure across the packer to facilitate unsetting of the packer, as more fully disclosed in U.S. Pat. No. 4,648,448. The packer may then be repositioned at a different depth in the well, or reset at its original position, by repeating the above-described process.

Figure 4:
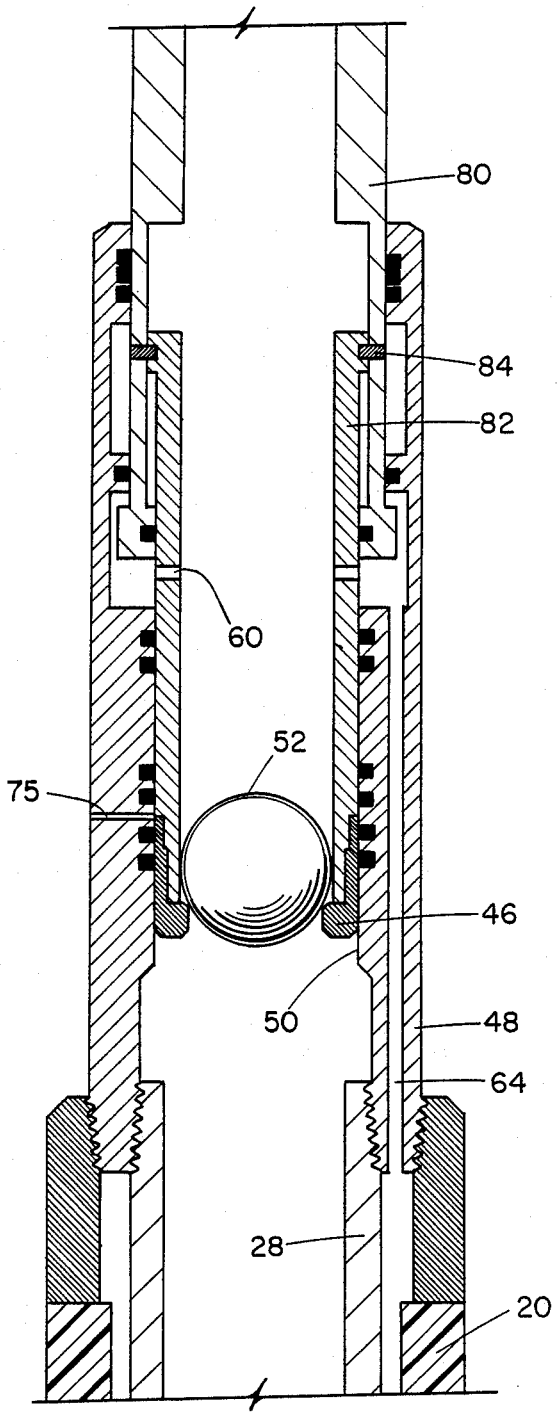
FIG. 4 is a cross-sectional view of an alternative embodiment of the apparatus depicted in FIG. 2, with the ball being restricted from downward movement by the stop members.
Figure 5:
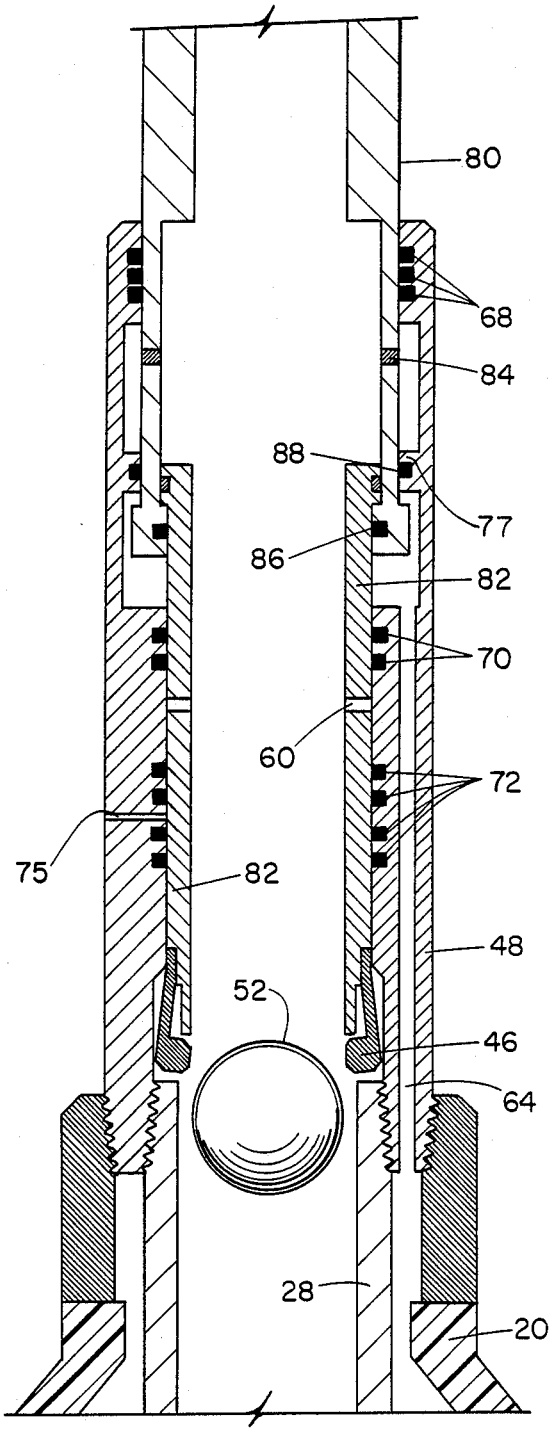
FIG. 5 is a cross-sectional view of the apparatus shown in FIG. 4 with the ball being released and passed by the stop members.

Another embodiment of the present invention is shown in FIGS. 4 and 5. An upper sub 80 is connected to the tubing string 16 in a conventional manner. Control tube 82 is connected to sub 80 by a suitable mechanical fastener, such as shear pin 84. The packer assembly is thus run in the well in the ball stop position, as shown in FIG. 4, with pin 84 interconnecting sub 80 and control tube 82. Once the ball is dropped and engages collet fingers 46, tubing pressure will pass through ports 60 and flow passage 64 to inflate the packer. An increase in tubing pressure over the selected inflation pressure will automatically shear pin 84, which is pre-sized to break at a calculated force resulting from this increase in tubing pressure. When pin 84 shears, tubing pressure automatically moves control tube 82 downward, so that port 60 will again be closed off by seals 70 and 72. Seal 86 at the lower end of sub 80 seals with the inner cylindrical surface of control tube 82, while seal 88 on the inner portion 77 of control sub 48 (which defines the J-shaped slot previously discussed) seals with the outer cylindrical surface of sub 80 to prevent fluid from leaking out the port which received the pin 84. Once the control tube 82 has moved to the ball release position as shown in FIG. 5, the collet fingers 46 may move radially outward so that the ball will be released and full bore capability will be restored.

In order to unset the packer assembly, the operator at the surface may set down, rotate and pick up on the tubing string in the manner previously described, thereby raising the control tube 82 to the ball stop position (functionally to the position as shown in FIG. 2). The collet fingers 46 will thus be moved radially inward by the surface 50 on the control sub 48. Additional packer setting and unsetting operations can then be accomplished in the manner previously described.

One advantage of the embodiment shown in FIGS. 4 and 5 is that neither axial nor rotational movement of the tubing string is necessary to drop a ball, pressure up on the tubing string, set the packer, then release the ball from the packer setting assembly. This feature may be important to an operator desiring to set a packer in a highly deviated or horizontal well bore.

Figure 6:
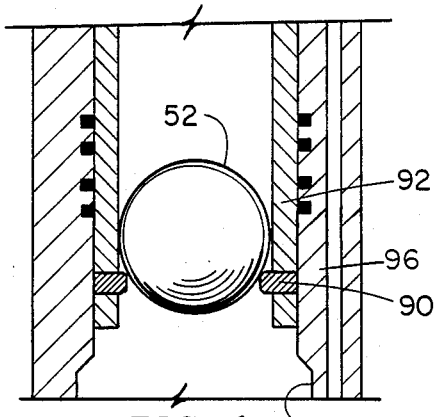
FIG. 6 is a cross-sectional view of an alternative embodiment of the apparatus depicted in FIGS. 2 and 4, with the ball being restricted from downward movement by the stop member.

Various modifications to the embodiments described are possible. Rather than using collet fingers, the ball may, for example, be restricted from passing through the control tube by a small button or stud, as shown in FIG. 6, which is radially movable from its inward or ball stop position to its outward or ball release position. The button 90 may then be restricted from radially outward movement while the control tube 92 is in the ball stop position, and the button 90 could be moved radially outward to a suitable recess 94 provided in the control sub 96 when the control tube 92 moved to the ball release position. The embodiment previously described and shown in the figures is preferred, however, for high reliability during multiple inflation cycles.

It may also be feasible to provide collet fingers or buttons which effectively stop axial downward movement of the ball in order to set the packer, then allow for the release of the ball to establish full bore capability, with no axial movement over the control tube. In this design, radially outward movement of the collet fingers or buttons would be resisted by a preselected biasing force, such as a spring. The spring would be sized to enable the stopping member to move radially outward in response to increased tubing pressure above the packer setting pressure, so that the ball would be released and pass by the packer assembly once the desired packer setting pressure was obtained. This action would release tubing pressure and automatically restore the stopping member to a ball stop position. (The flow path from the interior of the tubing string to the packer body may automatically be closed off by a check valve when the ball was released, which may thereafter be activated by surface manipulation of the tubing string or by an acoustic or electrical signal to open the check valve and unset the packer assembly.)

This latter design is, however, not preferred compared to the previously disclosed embodiments, since the radial movement of the collet fingers or buttons which would allow release of the ball would be limited to a specific tubing pressure. In other words, the operator would not have the flexibility, which is generally desired, of altering the pressure at which a packer is reset in a well bore during a single trip of the tubing string into the well bore. The preferred embodiments allow for any desired pressure setting to be obtained in the tubing string and thus the packer before the operator causes the closing off of the flow path to the packer and the release of the ball. In this latter described embodiment, this flexibility is not achieved, and the operator would either have to retrieve the packer assembly to the surface to change out the collet finger or button springs, or would have to reset the packer at the previous packer setting pressure. Also, radial movement of the collet fingers or buttons resisted by a spring may become difficult or impossible if well debris becomes inadvertently lodged in the cavity provided for the spring and/or the collet fingers or buttons.

It may also be feasible to accomplish multiple settings of a packer in a well bore during a single trip without any manual manipulation of the tubing string. A biasing force of a preselected size, such as a spring, may be used to bias the control tube axially toward its upper position, wherein the tubing pressure was sealed off from the pressure to the packer body. As the tubing pressure was increased, the control tube would move axially downward to an intermediate position, wherein the ports in the control tube would establish fluid communication between the interior of the control tube and the packer body. The packer would thus become inflated while the control tube was in the intermediate position, and the collet fingers would be maintained in the ball stop position when the control tube was in either its upper or intermediate positions. The spring may be sized so that the packer would thus become inflated to its desired setting pressure, at which time the ports through the control tube would pass by the seals and thus close off pressure communication between the interior of the tubing string and the interior of the set packer body. An additional increase in tubing pressure would further compress the spring, which would then move to its lowermost ball release position, at which time the ball would be released in the manner previously described. The release of the ball would quickly decrease pressure in the tubing string, which would allow the spring to automatically return the control tube to its upper position, so that the packer would remain set in the well bore. Manual manipulation of the tubing string may then be used to open a "dump" valve, which would release packer pressure either to the interior of the tubing string or to the annulus between the tubing string and the casing, as desired. The dump valve may, for example, be actuated by an acoustic or electrical signal from the surface, or by other conventional means. It may be possible to at least substantially reduce the pressure within the packer body by repressurizing the tubing string so that the control tube moved to its intermediate position, then reducing tubing pressure (as well as pressure to the packer body) until the control tube returned to its uppermost position. In any event, however, manual manipulation of the tubing string is not required in order to set or reset the packer in the well bore.

As previously noted, the ball used as the closure member for the packer assembly of the present invention is preferably fabricated from hardened steel. Another configuration of a closure member, such as a cylindrical-shaped plug with a tapered nose, may be employed if desired. If a closure member of this type is utilized, a substantially shorter control tube may be used, and the interior configuration of the control tube need not be cylindrical. The configuration of the control tube for use with a cylindrical-shaped plug may, for example, have an annular restriction of a curvilinear cross-sectional configuration for effectively shutting off fluid flow between this restriction and the sidewalls of the plug. Also, the cylindrical-shaped plug may include an external resilient seal, if desired, to minimize or prevent any substantial leakage of fluid past the closure member while the tubing pressure is increased to set the packer in the well bore.

The collet fingers are preferably spaced at selected intervals about the periphery of the control tube, and no intent need be made to seal between the collet fingers and the closure member. Since the interior surface of the control tube, or at least that portion adjacent the collet fingers, is preferably cylindrical when a ball is used as the closure member, the ball may be sized to freely pass through the control tube when the collet fingers are moved radially to the ball release position.

The apparatus and techniques described herein may be used for actuating or setting downhole tools other than inflatable packers, although the techniques of the present invention are particularly well suited to the repeatable setting and unsetting of inflatable packers as described herein during a single trip of the packer in the well bore. The techniques herein described may, for example, alternatively be used to repeatedly activate and deactivate drill stem test equipment or other downhole tools.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A multiple-set packer assembly for selectively positioning within a well bore to seal the annulus between interior walls of the well bore and a tubing string having a passageway, the packer assembly adapted to be set in the well bore by lowering a ball having a selectively sized diameter through the tubing string to plug the passageway and thereafter pressurizing fluid in the passageway above the set ball, the packer assembly comprising:

a flexible tubular packer body radially expandable and retractable for contact with and release from the interior walls of the well bore;

a control sub secured to the packer body and having an interior guide wall, a recessed cavity radially outward of the guide wall, and a flow path in pressure communication with the packer body whereby the packer body may be radially expanded by fluid pressure in the flow path in the control sub;

a sleeve axially movable within the control sub from a ball stop position to a ball release position, the sleeve having a cylindrical-shaped interior surface having a selectively sized diameter slightly larger than the diameter of the ball, and having a port for fluid communication between the passageway in the tubing string and the flow path in the control sub when the sleeve is in the ball stop position;

a seal for automatically closing off communication between the passageway in the tubing string and the flow path in the control sub when the sleeve is in the ball release position; and a stop member carried by the sleeve and radially movable from an inward position such that the ball is axially stopped by the stop member within the cylindrical shaped interior surface of the sleeve, to an outward position such that the ball may be passed axially by the sleeve and the stop member;

the stop member being restricted from radially outward movement to its outward position by the interior guide wall of the control sub when the sleeve is axially in the ball stop position, and the stop member being movable radially outward into the recessed cavity within the control sub when the sleeve is axially in the ball release position, whereby the ball may be lowered into engagement with the stop member when the sleeve is in the ball stop position, pressurized fluid in the passageway above the ball passed through the port in the sleeve and the flow path in the control sub for setting the packer assembly in the well bore, and the sleeve thereafter moved to the ball release position to seal pressurized fluid in the packer body and permit the ball to pass by the stop member as the stop member is positioned radially outward into the recessed cavity.

2. The packer assembly as defined in claim 1, wherein the sleeve is axially movable from the ball stop position to the ball release position by axial movement of the tubing string at the surface of the well bore.

3. The packer assembly as defined in claim 1, wherein the stop member comprises a plurality of collet fingers, each connected to the sleeve.

4. The packer assembly as defined in claim 1, wherein axial movement of the sleeve from the ball stop position to the ball release position is guided by the interior guide wall of the control sub.

5. The packer assembly as defined in claim 1, wherein the seal is carried on the control sub for sealing engagement with an external cylindrical-shaped surface on the sleeve.

6. The packer assembly as defined in claim 1, further comprising:

a locking member for axially interconnecting the control sub and the sleeve to maintain the sleeve in the ball stop position, and for releasing at a preselected force to allow fluid pressure in the passageway in the tubing string to move the sleeve axially to the ball release position.

7. The packer assembly as defined in claim 1, wherein the ball member is a metallic ball member having a diameter of less than approximately 0.002 inches less than the diameter of the cylindrical-shaped interior surface of the sleeve.

8. A multiple-set packer assembly for selectively positioning within a well bore to seal the annulus between interior walls of the well bore and a tubing string having a passageway, the packer assembly adapted to be set in the well bore by lowering a closure member having a selectively sized diameter through the tubing string to plug the passageway and thereafter pressurizing fluid in the passageway above the closure member, the packer assembly comprising:

flexible tubular packer body means radially expandable and retractable for contact with and release from the interior walls of the well bore;

control sub means secured to the packer body means and having an interior guide wall, a recessed cavity radially outward of the guide wall, and a flow path in pressure communication with the packer body means whereby the packer body means may be radially expanded by fluid pressure in the flow path in the control sub means;

sleeve means axially movable within the control sub means from a closure stop position to a closure release position, the sleeve means having an interior surface having a diameter larger than the selectively sized diameter of the closure member, and having a port for fluid communication between the passageway in the tubing string and the flow path in the control sub means when the sleeve means is in the closure stop position;

seal means for automatically closing off communication between the passageway in the tubing string and the flow path in the control sub means when the sleeve means is in the closure release position; and stop means carried by the sleeve means and radially movable from an inward position such that the closure member is axially stopped by the stop means within the interior surface of the sleeve means, to an outward position such that the closure member may be passed axially by the sleeve means and the stop means;

the stop means being restricted from radially outward movement to its outward position by the control sub means when the sleeve means is axially in the closure stop position, and the stop means being movable radially outward into the recessed cavity within the control sub means when the sleeve means is axially in the closure release position, whereby the closure member may be lowered into engagement with the stop means when the sleeve means is in the closure stop position, pressurized fluid in the passageway above the closure member passed through the port in the sleeve means and the flow path in the control sub means for setting the packer assembly, and the sleeve means thereafter moved to the closure release position to seal pressurized fluid in the packer body means and permit the closure member to pass by the stop means as the stop means is positioned radially outward into the recessed cavity.

9. The packer assembly as defined in claim 8, wherein the sleeve means is axially movable from the closure stop position to the closure release position by axial movement of the tubing string at the surface of the well bore.

10. The packer assembly as defined in claim 8, wherein the stop means comprises a plurality of collet fingers each connected to the sleeve means.

11. The packer assembly as defined in claim 8, wherein the seal means is carried on the control sub means for sealing engagement with an external cylindrical-shaped surface on the sleeve means.

12. The packer assembly as defined in claim 8, further comprising:

locking means for axially interconnecting the control sub means and the sleeve means to maintain the sleeve means in the closure stop position, and for releasing at a preselected force to allow fluid pressure in the passageway in the tubing string to move to the sleeve means to the closure release position.

13. The packer assembly as defined in claim 8, wherein the interior surface of the sleeve means has a generally cylindrical configuration.

14. A method of setting a packer assembly positioned in a well bore to seal the annulus between an interior wall of the well bore and a tubing string having a passageway, the packer assembly including a flexible tubing packer body radially expandable and retractable for contact with a release from the interior wall of the well bore, and a control sub secured to the packer body and having a flow path in pressure communication with the packer body whereby the packer body may be radially expanded by blocking the passageway with a closure member and increasing fluid pressure in the tubing string for transmission to the packer body through the control sub flow path, a method comprising:

providing an axially movable sleeve within the control sub movable between a closure stop position and a closure release position, the sleeve having an interior surface having a selectively sized diameter slightly larger than the diameter of the closure member, and a port for pressure communciation between the passageway in the tubing string and the flow path in the control sub when the sleeve is in the closure stop position;

providing a stop member carried by the sleeve and radially movable from an inward position such that the closure member is axially stopped within the sleeve by the stop member to an outward position such that the closure member may pass axially by the stop member;

restricting the stop member from radial movement to the outward position when the sleeve is axially in the closure stop position;

lowering the closure member through the tubular string to engage the stop member while the sleeve is in the closure stop position;

increasing fluid pressure in the passageway above the closure member within the tubular string when the sleeve is in the closure stop position to set the packer assembly in the well bore;

closing off communication between the passageway in the tubular string and the flow path in the control sub when the sleeve is in the closure release position; and moving the sleeve axially to the closure release position and the stop member radially to its outward position while simultaneously sealing fluid within the flow path of the control sub to maintain the packer assembly in the set position.

15. The method as defined in claim 14, wherein the stop member is restricted from radial movement to the outward position by engaging an interior guide surface on the control sub.

16. The method as defined in claim 14, wherein the closure member is a metal-material ball which is lowered through the tubing string by dropping the ball from adjacent the surface of the well bore, and the interior surface of the sleeve means has a generally cylindrical configuration.

17. The method as defined in claim 14, wherein the sleeve is axially moved from the ball stop position to the ball release position by manual manipulation of the tubing string at the surface.

18. The method as defined in claim 14, further comprising:

axially interconnecting the control sub and the sleeve to temporarily maintain the sleeve in the closure stop position and for releasing the sleeve at a preselected force to permit the sleeve to move axially to the closure release position.

19. The method as defined in claim 14, wherein the sleeve is biased to the closure stop position.

20. The method as defined in claim 14, wherein the step of closing off communication between the passageway in the tubular string and the flow path in the control sub comprises:

providing a seal carried on the control sub for sealing engagement with an external cylindrical-shaped surface on the sleeve.

* * * * *